United States Patent [19]

Byrd

[11] 4,283,265

[45] Aug. 11, 1981

[54] EXPANDABLE ELECTRODE

[75] Inventor: Geoffrey C. M. Byrd, Frodsham, England

[73] Assignee: Imperial Chemical Industries Limited, London, England

[21] Appl. No.: 141,916

[22] Filed: Apr. 21, 1980

[30] Foreign Application Priority Data

May 2, 1979 [GB] United Kingdom ..... 15226/79

[51] Int. Cl.[3] ..... C25B 11/02

[52] U.S. Cl. ..... 204/252; 204/266; 204/284; 204/286; 204/288

[58] Field of Search ..... 204/252, 266, 284, 286, 204/288

[56] References Cited

U.S. PATENT DOCUMENTS

| | | | |
|---|---|---|---|
| 3,674,676 | 7/1972 | Fogelman | 204/286 |
| 3,941,676 | 3/1976 | Macken | 204/266 |
| 4,026,785 | 5/1977 | Ford | 204/286 |
| 4,080,279 | 3/1978 | Poush et al. | 204/252 |
| 4,120,773 | 10/1978 | Ridgway | 204/252 |
| 4,141,814 | 2/1979 | Boulton | 204/252 |
| 4,162,953 | 7/1979 | Denora et al. | 204/252 |

*Primary Examiner*—F. C. Edmundson

*Attorney, Agent, or Firm*—Cushman, Darby & Cushman

[57] ABSTRACT

An expandable electrode for use in an electrolytic cell of the diaphragm or membrane type and comprising a pair of electrode plates bridged along one edge of each plate, and located between the plates in a plane essentially perpendicular to the faces of the plates at least one spacing member which in profile is in the form of one or more substantially wedge-shaped sections and which is movable relative to the electrode plates, the electrode plates being provided with one or more transverse members which, upon movement of the spacing member relative to the plates, is or are engaged by the wedge-shaped sections(s) of the spacing member(s) to control the spacing between the electrode plates. The spacing member preferably comprises one or more double wedge-shaped sections and the electrode plates are preferably slotted plates, for example louvred plates.

20 Claims, 8 Drawing Figures

EXPANDABLE ELECTRODE

Figure 1:
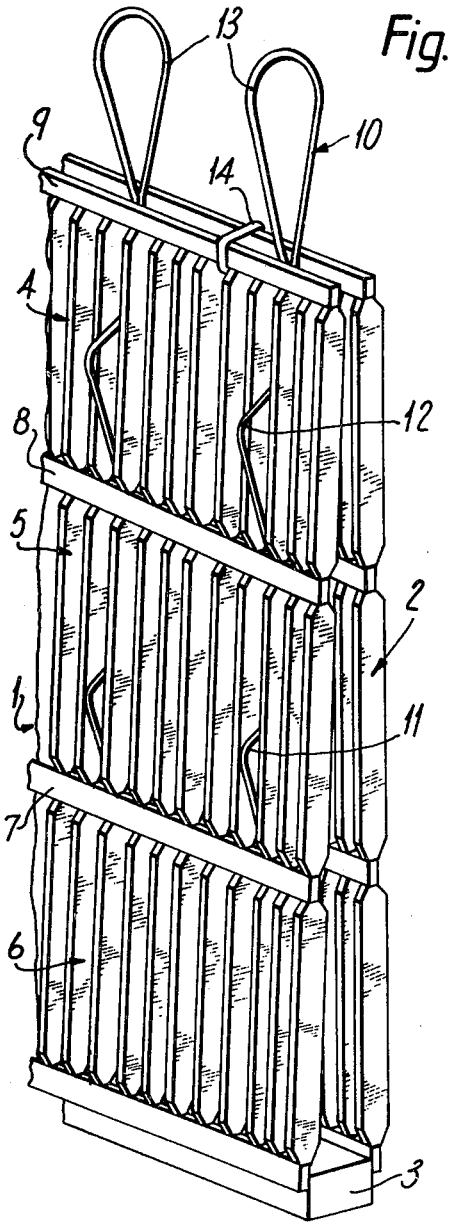

This invention relates to an expandable electrode for an electrolytic cell of the diaphragm or membrane type and to a method of assembling the electrodes in an electrolytic cell. The invention is particularly concerned with an expandable electrode, usually an anode, for a diaphragm or membrane electrolytic cell intended for the production of chlorine and aqueous alkali metal hydroxide solution by the electrolysis of an aqueous alkali metal chloride solution, and to a method of assembling the electrode in such a cell without damaging the diaphragm or membrane during location of the electrode in the cell.

A variety of diaphragm and membrane electrolytic cells are known or have been proposed which embody the common principle of a series of alternating, essentially parallel anodes and cathodes wherein the opposed surfaces of each anode/cathode pair are separated by a diaphragm or membrane. In a typical electrolytic cell of this type the cathodes are formed into a unitary structure, commonly called a cathode box, having a series of slots therein each of the slots being formed by a pair of opposed cathode surfaces. The cathode surfaces are generally of foraminate construction and may be formed for example of a mesh or of an expanded metal. In an alternative design the cathode box may comprise a series of fingers each formed by a pair of opposed cathode surfaces. In the electrolytic cell the anodes, which may be mounted on a common base, are positioned in the slots of the cathode box or between the fingers of the cathode box, and in a commonly used type of electrolytic cell each of the anodes comprises a pair of anode plates. The anode plates may for example be of foraminate construction, e.g. they may be of a mesh construction, of expanded metal, or they may be of a slotted or louvred construction.

In the electrolytic cell a diaphragm or membrane is located between each pair of opposed anode/cathode surfaces thus dividing the cell into separate anode and cathode compartments. The diaphragm or membrane may for example cover the foraminate surfaces of the cathode box, e.g. at least the surfaces of the slots or fingers therein. For example, the cathode surfaces may be covered with an asbestos diaphragm by depositing an aqueous slurry of asbestos fibres onto the cathode surfaces. Alternatively, pre-formed sheets of diaphragm or membrane material may be clad onto the cathodes surfaces.

Irrespective of the precise cell construction it is convenient in practice for one series of electrodes, usually the cathodes, to carry or support the diaphragm or membrane and for the other series of electrodes, usually the anodes, to be located in the spaces between the electrodes of the first series so that a diaphragm or membrane is located between each pair of opposed anode/cathode surfaces.

In such electrolytic cells it is desirable to have a small anode-cathode gap, or even to have a zero anode-cathode gap, that is to have both the anode and cathode close to or in contact with the diaphragm or membrane. During assembly of such an electrolytic cell, and in particular when positioning the anodes in the spaces between the cathodes, there is a risk that the diaphragms or membranes will become damaged.

In order to reduce the aforementioned risk of damage during assembly of the electrolytic cell, whilst at the same time enabling small or zero anode/gaps to be provided, it has been proposed to employ an expandable electrode which is inserted into the cell in a collapsed condition and expanded in situ. Normally, the expandable electrode is an anode which is expanded in situ, that is whilst located in the space between adjacent diaphragm - or membrane-covered cathodes, to reduce the anode/cathode gaps and if desired to trap the diaphragms or membranes between the opposed anode/-cathode surfaces.

In general, an expandable electrode comprises a pair of spaced opposed electrode plates interconnected in such a way that the gap between them may be varied.

For example, there is described in U.S. Pat. No. 4,026,785 an adjustable electrode comprising two electrode surfaces positioned in parallel and having a space between them and each being rigidly attached to a separate electrode post.

Removable clamping means are attached to the upper portions of the electrode surfaces in order to bias the electrode surfaces towards each other and to the electrode post. When the clamping means are removed the electrode surfaces spring apart. In U.S. Pat. No. 3,674,676 there is described an electrode comprising an electrode riser post positioned between two substantially parallel spaced-apart electrode surfaces and connected to the surfaces by means of movable electrically conductive connecting means which bias the electrode surfaces in directions towards the riser post, that is into a collapsed condition. The gap between the electrode surfaces may be caused to increase by positioning spacer bars between the electrode surfaces. In U.S. Pat. No. 4,080,279 there is described an anode assembly comprising two foraminate working surfaces biassed towards each other by a spring memory and a spreading means comprising rotatable spacer plates. Yet a further type of expandable electrode is described in U.S. Pat. No. 3,941,676 the electrode comprising a rotatable cranked electrode riser post connected to and positioned between two substantially parallel electrode surfaces. Rotation of the electrode riser post causes the electrode surfaces to move apart.

The present invention relates to an expandable electrode for use in an electrolytic cell of the diaphragm or membrane type which is very simple in construction, which does not require the provision of an electrode riser post and means for electrical connection between the riser post and the electrodes, which is simple to operate, and which is adapted to vary the gap between the electrode plates to a spacing as desired.

According to the present invention, there is provided an expandable electrode suitable for use in an electrolytic cell of the diaphragm or membrane type, and comprising a pair of electrode plates bridged along one edge of each plate, and located between the plates in a plane essentially perpendicular to the faces of the plates at least one spacing member which in profile is in the form of one or more substantially wedge-shaped sections and which is movable relative to the electrode plates, the electrode plates being provided with one or more transverse members which upon movement of the spacing member relative to the plates is or are engaged by the wedge-shaped section(s) of the spacing member(s) to control the spacing between the electrode plates.

The dimensions of the spacing member and the transverse member(s) and the spatial location of the transverse member(s) relative to the electrode plates may be selected such that when the electrode is in a collapsed condition, that is when the spacing member is in a retracted position with the wedge-shaped section(s) not engaging the transverse member(s), the spacing member may be positioned entirely between the electrode plates. Alternatively, and preferably, and particularly where the electrode plates have an appreciable thickness, slots may be provided in the plates such that when in its retracted position the wider wedge-shaped sections of the spacing member lie within the slots in the electrode plates or project through the slots.

Thus, in a preferred embodiment of the expandable electrode the electrode plates comprise a plurality of slots, which may be essentially vertical, and one or more transverse members bridging the slots.

According to a particular embodiment of the invention, there is provided an expandable electrode, suitable for use in an electrolytic cell of the diaphragm or membrane type, and comprising a pair of slotted electrode plates bridged along one edge of each plate, and located between the plates in a plane essentially perpendicular to the faces of the plates at least one spacing member which in profile is in the form of one or more substantially wedge-shaped sections, the spacing member being movable relative to the electrode plates in a direction parallel to the plates and being aligned with slots in the plates such that the wider wedge-shaped sections(s) of the spacing member lie within or project through the slots in the plates when the electrode is in a collapsed condition, and the slots in the plates being bridged by one or more transverse members such that upon movement of the spacing member relative to the plates the wedge-shaped sections of the spacing member engage the transverse members on the plates and control the spacing between the electrode plates.

In the electrode of the invention, the maximum dimension across the wedge-shaped sections of the spacing member is equal to or greater than the maximum separation required between the transverse members of the electrode plates with which the spacing member engages.

The spacing member will usually have more than one wedge-shaped section so as to exert a spacing influence on more than one transverse member on the electrode plate; in general the member will have two or three wedge-shaped sections. It will be usual also to provide more than one spacing member. Thus for instance in an electrode several feet in length there will usually be provided spacing members at intervals, say of 6 inches, along the length of the electrode plates.

Louvred plates are a particularly suitable form of slotted plate for use in the expandable electrode of the invention. The electrode plates in such an electrode comprise a plurality of parallel, spaced blades the gaps between the blades providing a plurality of slots in the electrode plates. The spacing member may be located in alignment with any one of these slots. For robustness, the blades of each louvred electrode plate may be interconnected at intervals along their length, for example by means of an unlouvred portion of the plate or by means of a transverse member in the form of a connection rod or bar extending across the plate at right angles to the electrode blades. In this construction, the unlouvred portions or the connecting rod or bar serves as a bridge-piece between adjacent blades, that is, a bridge across the slot between the blades, and provides the transverse member necessary for engagement by the spacing member when the latter is moved relative to the electrode plates into the operative position.

The electrode plates may be made of an electrically conducting metal, and in general the expandable electrode of the invention will provide an anode for use in an electrolytic cell.

In the expandable electrode the electrode plates are bridged along one edge of each plate to form an electrode unit. Particularly where the expandable electrode is to be used as an anode the plates may be mounted on a sheet of an electrically conducting material which forms the baseplate of the electrolytic cell, the baseplate providing the bridging means. Alternatively, the electrode plates may be connected to separate bridging means which may be mounted on the baseplate of the electrolytic cell. The bridging means may provide an electrical connection between the electrode plates.

Particularly where the expandable electrode is to be used as an anode in an electrolytic cell, for example in an electrolytic cell for the production of chlorine and alkali metal hydroxide solution by the electrolysis of alkali metal halide solution, the electrode plates may be made of a film-forming metal or alloy, for example titanium, and the faces of the electrode plates which in the cell are to face the cathode may carry a coating of an electro-conducting electrocatalytically active material. Such materials are well known in the art and include for example platinum group metals, platinum group metal oxides, or a mixture of a platinum group metal oxide and a non-noble metal oxide, for example a film-forming metal oxide, e.g. titanium dioxide.

The spacing member may be a strip or bar of metal, plastic or other suitable material resistant to the gases and liquids the spacing member may encounter in the electrolytic cell, shaped to provide the wedge-shaped section(s), or it may be for example a wire, e.g. a titanium wire, bent to the desired shape having the wedge-shaped section(s). A solid member such as a shaped strip or bar has the advantage of ease of fabrication, for example by stamping from a sheet.

The spacing member is located in the electrode unit such that it lies in a plane essentially perpendicular to the faces of the electrode plates. When using slotted plates, for example louvred electrode plates, location of the widest portions of the spacing member having wedge-shaped section(s) within slots in the electrode plates or projecting through the slots when the electrode plates are at less than maximum separation ensures that the spacing member cannot twist out of the desired plane, and it is preferred to shape the spacing member such that even when the plates are at maximum desired separation there is still a small portion of the spacing member retained within the slots in the plates to prevent the member from twisting out of the desired plane. This can be achieved, for example, by making the maximum dimension of the wedge-shaped section(s) of the spacing member slightly greater than the maximum desired separation of the transverse members of the plates engaged by the spacing member. In the case of electrode plates which do not have slots, guides for the spacing member may be provided, for example on the transverse member, to prevent the spacing member from twisting out of the desired plane.

In assembling the expandable electrode of the invention in the form of an anode in an electroyltic cell the electrode, or a plurality of the electrodes mounted for example on a cell base, are positioned, in a collapsed or unexpanded condition, in the spaces between the cathodes, for example in the slots or between the fingers of a cathode box. The electrode plates of the electrode may be restrained in a collapsed condition, if necessary, by means of a retaining clip positioned over the electrode plates, e.g. over the top of the electrode plates. The spacing member will be in a retracted position during positioning of the anodes, for example with the wedge-shaped sections of the spacing member positioned within or projecting through slots in the electrode plates so as not to damage the diaphragm or membrane during assembly.

To expand the electrode plates the retaining clip is removed and the spacing member(s) are moved relative to the electrode plates so that the wedge-shaped sections thereof engage the transverse members of the plates and separate the plates to the desired extent. Such a method of assembling an electrolytic cell is provided according to a further feature of the invention.

A particularly preferred form of electrode according to the invention is one wherein the electrode plates are connected along one edge and are biased outwardly by spring memory to form a unit of generally 'V'-shaped configuration. When assembling such an electrode in a cell, removal of the clip retaining the electrode in the collapsed condition results in the electrode plates springing apart. Usually a second clip will be provided over the free ends of the electrode plates to limit, in association with the spacing member(s), the extent to which the plates may move apart.

Since it is necessary to move the spacing member relative to the electrode plates after the electrode is located in the cell, it is preferable that the end of the member be readily accessible when the electrode is in position in the cell. Where the expandable electrode is an anode the end of the spacing member will be accessible from above the bank of assembled anodes and cathodes and the spacing member will usually be disposed vertically and be movable vertically.

The spacing member can be so shaped as to impart a desired surface configuration to the electrode plates. In one of its simplest embodiment, the spacing member has a profile of more than one wedge-shaped section all of the same dimensions so that when the member is in operative position between the electrode plates, separation of the plates is uniform and the plate surfaces are essentially parallel over most of their length. The electrical connection between the electrode plates will however usually be of fixed dimension so that the separation of the plates at their point of connection will not be variable and this may cause a departure from parallel plate surfaces over the portion of the plates adjacent to the point of electrical connection.

It is possible, however, to provide wedge-shaped sections of different dimensions at various positions on the spacing member so that when the member is in the operative position between the electrode plates, the separation of the plates by the member may be different at different positions along the spacing member. Thus for example, the spacing of the electrode plates imposed by one end of the spacing member may be greater than that imposed by the other end of the spacing member so that the electrode plates adopt a substantially 'V'-shaped configuration.

By causing the electrode plates in say an anode to adopt a non-parallel configuration it will be appreciated that location of the anode between parallel cathode surfaces affords a method of varying the gap between opposed anode and cathode surfaces at various positions. For example, where the cathodes in an electrolytic cell are vertically disposed a 'V'-shaped anode as described may provide a wider anode-cathode gap adjacent the bottom of the anode plates than adjacent the top of the anode plates, as is described for example in our Belgian Pat. specification No. 857,237.

The electrolytic cell in which the expandable electrode of the invention may be installed may be of the diaphragm or membrane type. Thus, the diaphragm may be a micro-porous diaphragm permeable to the electrolyte in the cell, for example of asbestos, or it may be a diaphragm of an organic polymeric material, particularly a diaphragm in the form of a porous sheet of a fluoropolymer, e.g. polytetrafluoroethylene.

Where the electrolytic cell is of the membrane type the membrane may suitably be an essentially hydraulically impermeable ion perm-selective membrane, particularly a cation perm-selective membrane.

Depending on the nature of the electrolyte to be electrolysed in the cell a suitable diaphragm or membrane may be chosen, particularly by reference to the literature, and it is not necessary in the present specification to provide guidance on the choice of diaphragm or membrane.

The expandable electrode of the invention is particularly suitable for use, especially as an anode, in an electrolytic cell for the electrolysis of aqueous alkali metal chloride solution to produce alkali metal hydroxide and chlorine, for example in an electrolytic cell for the production of chlorine and sodium hydroxide by the electrolysis of aqueous sodium chloride solution. The expandable electrode is however not limited to use in an electrolytic cell of this type.

Embodiments of the invention will now be described by way of example only with reference to the accompanying drawings which illustrate expandable electrodes according to the invention, suitable for use as anodes, containing spacing members, and their assembly into an electrolytic cell.

In The Drawings

Figure 1A:
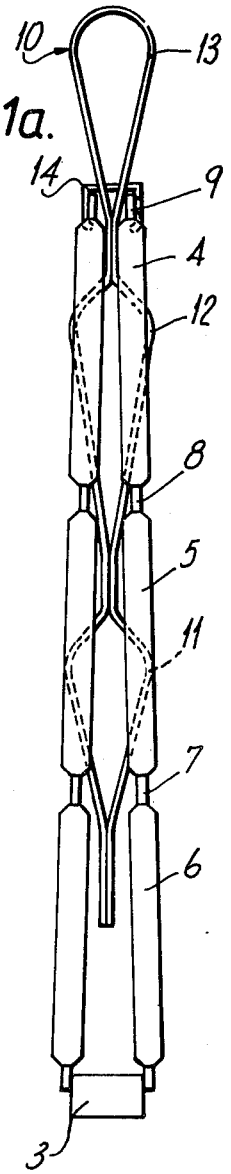
Figure 2:
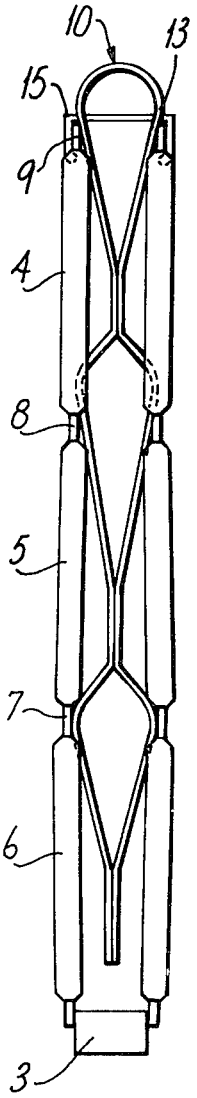
Figure 3:
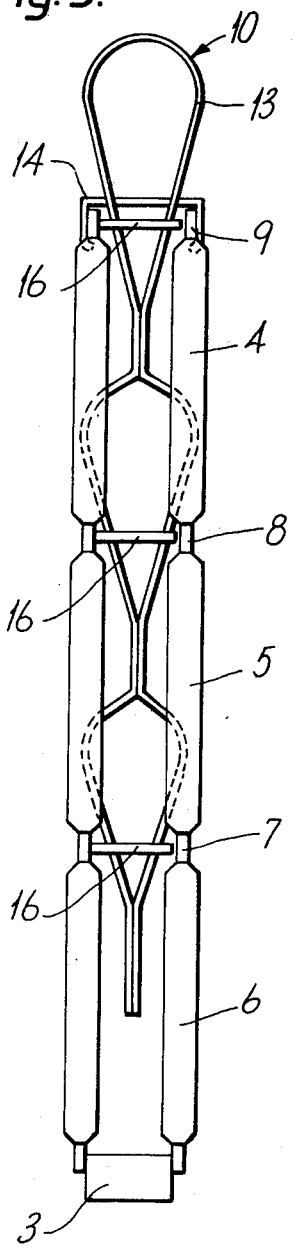
Figure 4:
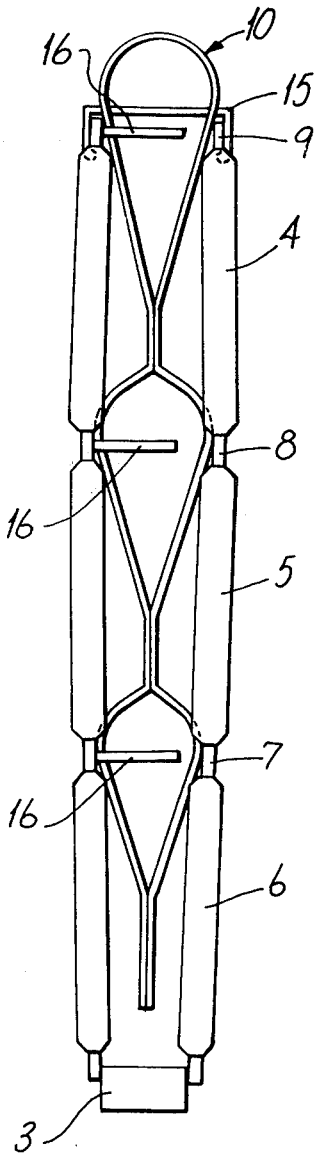
Figure 5:
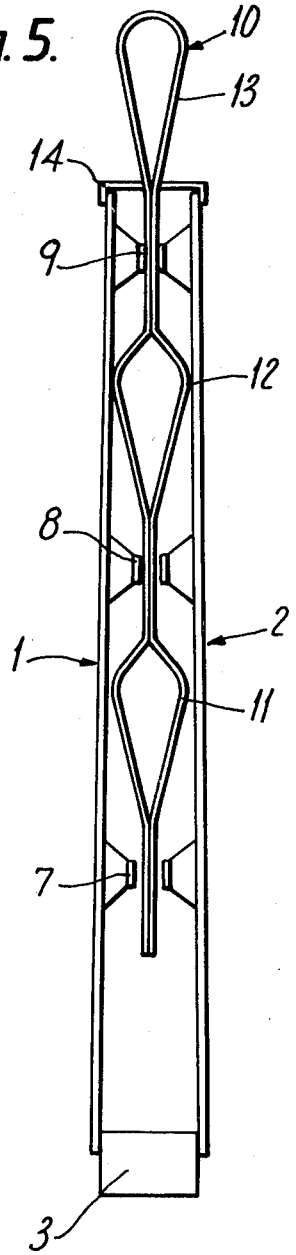
Figure 6:
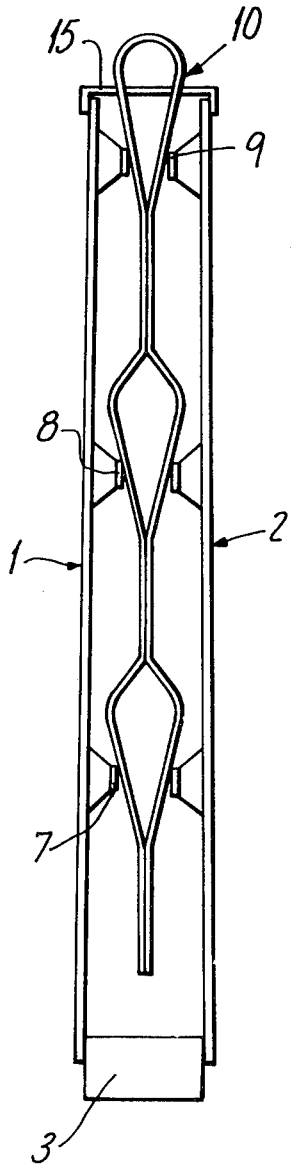
Figure 7:
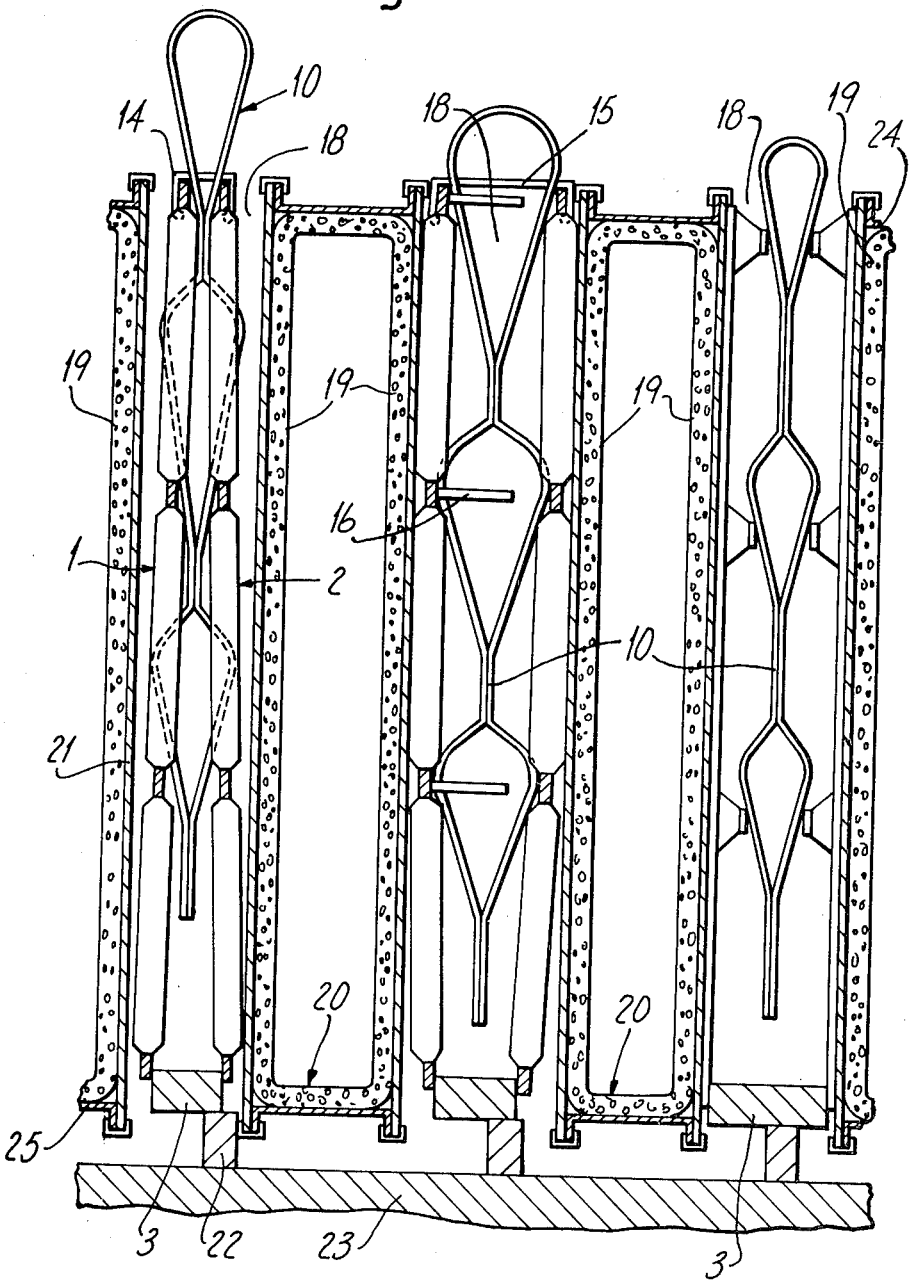

FIGS. 1, 1*a* and 2 show an anode containing spacing member(s) in the retracted position (FIGS. 1 and 1*a*) and in the operative position (FIG. 2), FIGS. 3 and 4 show an alternative form of anode to that shown in FIGS. 1, 1*a* and 2, FIGS. 5 and 6 show a further form of anode, and FIG. 7 shows a section of a diaphragm or membrane electrolytic cell containing expandable anode(s) of the invention with the spacing member(s) in the retracted and operative positions.

The anode shown in FIGS. 1, 1*a* and 2 comprises a pair of louvred plates 1 and 2 connected along one edge of each plate to a bridge piece 3 through which electric current may be fed to the anode plates. The plates are biased outwardly by a spring memory to provide an anode of essentially 'V'-shaped section. Each anode plate comprises three banks 4, 5 and 6 of anode blades separated by transverse bars 7 and 8 which bridge the slots between adjacent anode blades. The anode blades are also connected at their upper ends by a further transverse bar 9. Located between the anode plates 1 and 2 is a spacing member 10 having a profile containing three double-wedge-shaped sections 11, 12 and 13 and being a titanium wire shaped to have the desired profile.

In the retracted position shown in FIGS. 1 and 1*a* the spacing member does not exert a spacing influence on the anode plates 1 and 2 and its wedge-shaped portions 11 and 12 lie in and through slots between adjacent anode blades in the anode plates. Wedge-shaped portion 13 of the spacing member is positioned above the anode plates 1 and 2 adjacent to the bars 9 at the upper ends of the anode plates, which bars 9 are clipped together by a bent wire retaining clip 14. In this position, the anode is in its collapsed condition ready for insertion in a cell as described hereinafter.

FIG. 2 shows the anode unit of FIG. 1 in an expanded condition. In this position, retaining clip 14 has been removed and the spacing member 10 has been moved between the anode plates 1 and 2 so that the wedge-shaped portions 11, 12 and 13 have engaged the transverse bars 7, 8 and 9 respectively of the anode plates and has separated the plates, that is the anode is expanded. To counter the outwards bias of plates 1 and 2 and limit their separation, a bent wire clip 15 has been applied over the bars 9 at the upper ends of the anode plates 1 and 2.

In FIGS. 3 and 4, like parts to those shown FIGS. 1 and 2 bear the same reference numerals. The anode shown in FIGS. 3 and 4 differs from the anode shown in FIGS. 1 and 2 only in that spacer pegs 16 are attached to bars 7 and 8 of anode plate 1 to provide in the collapsed position, a minimum gap between the anode plates.

FIGS. 5 and 6 show an alternative form of anode in which the anode plates are sheets of electrically conductive material, e.g. foraminous sheets, which do not contain slots. For simplicity, parts corresponding to parts shown in FIGS. 1 to 4 are denoted by the same reference numerals. However, as shown in FIGS. 5 and 6, the transverse members or bars 7, 8 and 9 are offset from the major plane of the anode plates and are located internally of the surfaces of the anode plates.

FIG. 7 illustrates the method of assembling an electrolytic cell using the anodes of FIGS. 1 to 6.

In the embodiment of FIG. 7 a plurality of anodes each having a pair of louvred anodes plates 1 and 2 each connected along one edge to a bridge piece 3 are mounted on studs 22 on a cell base 23 formed for example of titanium or other film-forming metal. The electrolytic cell also comprises a cathode box 20 having a plurality of slots 18 formed by substantially parallel foraminate cathode surfaces 19. The cathode surfaces 19 are covered by a diaphragm or membrane material 21 in the form of sleeves positioned in the slots 18 and fastened to slotted upper 24 and lower 25 diaphragm or membrane supporting members.

In the embodiment shown in FIG. 7 the anode of FIGS. 1, 1*a* and 2 is shown as the anode on the left hand side of FIG. 7, the anode of FIGS. 3 and 4 as the anode in the centre of FIG. 7, and the anode of FIGS. 5 and 6 as the anode at the right hand side of FIG. 7.

In order to assemble the electrolytic cell the anode in a collapsed condition, as shown at the left hand side of FIG. 7, is located into the slot 18 of the cathode box 20 so that a sheet of diaphragm or membrane is located between opposed anode/cathode surfaces. It will be apparent that attempting to insert into the gap 18 an anode not in the collapsed state is liable to lead to damage of the diaphragm or membrane by the anode. On the other hand, a collapsed anode (FIGS. 1, 1*a*, 3 and 5) may be inserted into the slot 18 with little risk of damage to the diaphragm and membrane. After insertion of the collapsed anode in the slot 18, the retaining clip 14 is removed and the plates 1 and 2 spring apart.

Spacing member 10, the end of which is accessible from above the electrode assembly, is pushed downwards so that the wedge-shaped portions 11, 12 and 13 engage the transverse bars 7, 8 and 9 and the retaining clip 15 is applied. In this position the spacing member serves to space the anode plates 1 and 2 at the desired separation to provide the desired anode/cathode gaps. If desired, the diaphragm or membrane may become trapped between the anode and the adjacent cathodes to provide a zero anode/cathode gap.

It will readily be appreciated that whilst the anodes described have a spring memory outwards so that the electrode plates spring apart upon removal of the retaining clip 14, it is not essential that the electrode has an outwardly biassing spring memory and that movement of the spacing member into its operative position may force the electrode plates apart and effect the desired separation of the electrode plates.

I claim:

1. An expandable electrode suitable for use in an electrolytic cell of the diaphragm or membrane type, and comprising a pair of electrode plates bridged along one edge of each plate, and located between the plates in a plane essentially perpendicular to the faces of the plates at least one spacing member which in profile is in the form of one or more substantially wedge-shaped sections and which is movable relative to the electrode plates, the electrode plates being provided with one or more transverse members which upon movement of the spacing member relative to the plates is or are engaged by the wedge-shaped section(s) of the spacing member(s) to control the spacing between the electrode plates.

2. An expandable electrode as claimed in claim 1 in which the spacing member is positioned entirely between the electrode plates when the wedge-shaped section(s) of the spacing member(s) are not in engagement with the transverse member(s) of the electrode plates.

3. An expandable electrode as claimed in claim 1 in which a plurality of slots are provided in the electrode plates, the plates having one or more transverse members bridging the slots.

4. An expandable electrode as claimed in claim 3 in which, when the wedge-shaped section(s) of the spacing member(s) are not in engagement with the transverse member(s) of the electrode plates, the wedge-shaped section(s) lie within or project through the slots in the electrode plates.

5. An expandable electrode as claimed in claim 3 in which the slots in the electrode plates are essentially vertical.

6. An expandable electrode as claimed in claim 3 suitable for use in an electrolytic cell of the diaphragm or membrane type, and comprising a pair of slotted electrode plates bridged along one edge of each plate, and located between the plates in a plane essentially perpendicular to the faces of the plates at least one spacing member which in profile is in the form of one or more substantially wedge-shaped sections, the spacing member being movable relative to the electrode plates in a direction parallel to the plates and being aligned with slots in the plates such that the wider wedge-shaped section(s) of the spacing member lie within or project through the slots in the plates when the electrode is in a collapsed condition, and the slots in the plates being bridged by one or more transverse members such that upon movement of the spacing member relative to the plates the wedge-shaped section(s) of the spacing member engage the transverse members on the plates and control the spacing between the electrode plates.

7. An expandable electrode as claimed in claim 1 in which the wedge-shaped member comprises a plurality of wedge-shaped sections.

8. An expandable electrode as claimed in claim 7 in which the wedge-shaped member comprises two or three wedge-shaped sections.

9. An expandable electrode as claimed in claim 1 in which the wedge-shaped sections have the form of a double wedge-shape.

10. An expandable electrode as claimed in claim 3 in which the slots in the electrode plates are cut so as to leave a portion of the sheet between aligned slots which portion acts as the transverse member.

11. An expandable electrode as claimed in claim 1 which comprises a plurality of spacing members.

12. An expandable electrode as claimed in claim 1 in which the electrode plates are louvred plates.

13. An expandable electrode as claimed in claim 1 which is suitable for use as an anode and which is made of a film-forming metal or alloy.

14. An expandable electrode as claimed in claim 1 in which the electrode plates are mounted on a sheet of an electrically conducting material which forms the baseplate of an electrolytic cell and which provides the bridging means between the electrode plates.

15. An expandable electrode as claimed in claim 1 in which the electrode plates are mounted on separate bridging means which are in turn mounted on a baseplate of an electrolytic cell.

16. An expandable electrode as claimed in claim 1 in which the spacing member is in the form of a wire shaped to provide in profile one or more wedge-shaped sections.

17. An expandable electrode as claimed in claim 1 which is provided with a retaining clip to restrain the electrode plates in a collapsed condition.

18. An expandable electrode as claimed in claim 1 in which the electrode plates are biassed outwardly.

19. An expandable electrode as claimed in claim 18 which is provided with a clip which, in association with the spacing member(s), limits the extent to which the electrode plates may move apart.

20. An electrolytic cell comprising one or more expandable electrodes as claimed in claim 1.

* * * * *